US010390628B2

(12) United States Patent
Pisani

(10) Patent No.: US 10,390,628 B2
(45) Date of Patent: Aug. 27, 2019

(54) INSTANT HAND-HELD BED SHEET WARMER

(71) Applicant: William Pisani, Trumbull, CT (US)

(72) Inventor: William Pisani, Trumbull, CT (US)

( * ) Notice: Subject to any disclaimer, the term of this patent is extended or adjusted under 35 U.S.C. 154(b) by 0 days.

(21) Appl. No.: 16/119,104

(22) Filed: Aug. 31, 2018

(65) Prior Publication Data

US 2019/0069689 A1 Mar. 7, 2019

Related U.S. Application Data

(60) Provisional application No. 62/553,224, filed on Sep. 1, 2017.

(51) Int. Cl.
*A47C 21/04* (2006.01)
*F24H 3/04* (2006.01)

(52) U.S. Cl.
CPC ..... *A47C 21/048* (2013.01); *F24H 3/0423* (2013.01)

(58) Field of Classification Search
CPC ..... A45D 20/10; A47K 10/48; D06F 87/00; F24F 1/01
USPC ..... 219/200, 300; 392/300
See application file for complete search history.

(56) References Cited

U.S. PATENT DOCUMENTS 3,890,984 A * 6/1975 Lesetar ..... A45D 20/50 132/238
4,023,578 A * 5/1977 Buhler ..... A45D 20/50 132/269
4,151,658 A * 5/1979 Hibino ..... A47C 21/048 126/205
4,197,448 A * 4/1980 Harigai ..... A45D 20/10 132/212
4,328,818 A * 5/1982 Glucksman ..... A45D 20/50 132/271
4,430,808 A * 2/1984 Toyomi ..... A45D 20/50 132/116
4,520,256 A * 5/1985 Doyle ..... A45D 1/04 132/232
4,926,027 A * 5/1990 Montagino ..... A45D 20/12 132/271
4,984,316 A * 1/1991 Simpson ..... A47C 21/048 5/423

(Continued)

FOREIGN PATENT DOCUMENTS

JP 2016047115 A 4/2016
JP 2016047212 A 4/2016

*Primary Examiner* — Tu B Hoang
*Assistant Examiner* — Vy T Nguyen
(74) *Attorney, Agent, or Firm* — Ware, Fressola, Maguire & Barber LLP

(57) ABSTRACT

A hand-held bed sheet warmer device is provided for heating bedding, including an air intake configured to intake air, a fan and heating coil assembly to receive and heat the air to provide warm air, a handle configured in between the air intake and the fan and heating coil assembly and having a hollow cavity formed therein to allow the air to pass through the handle from the air intake to the fan and heating coil assembly, and a warm air distributor rod configured to receive the warm air and comprising a plurality of outlet vents configured to distribute the warm air to the bedding. The air intake, the fan and heating coil assembly, the handle and the warm air distributor are arranged linearly and the device is configured as a hand-held baton or shaft.

17 Claims, 3 Drawing Sheets

(56) References Cited

U.S. PATENT DOCUMENTS 5,091,630 A * 2/1992 Djuric ..... A45D 20/12 132/112
5,365,037 A * 11/1994 Chan ..... A45D 4/10 132/227
5,467,423 A * 11/1995 Jakubowski ..... A47G 1/02 15/250.03
5,592,749 A * 1/1997 Trimmer ..... A45D 20/14 219/541
5,842,286 A 12/1998 Cantor
5,887,303 A 3/1999 Raith
6,415,104 B1 * 7/2002 Fitts ..... C08L 9/00 219/544
6,425,527 B1 * 7/2002 Smole ..... F24F 7/00 236/49.3
6,711,767 B2 * 3/2004 Klamm ..... A47C 21/022 5/423
7,036,575 B1 5/2006 Rodney et al.
7,509,998 B1 * 3/2009 Rodney ..... A47C 21/044 165/138
7,913,332 B1 3/2011 Barnhart
8,155,508 B2 4/2012 Caine et al.
8,341,853 B2 1/2013 French et al.
8,347,521 B2 1/2013 Churchill et al.
8,347,522 B2 1/2013 Dyson et al.
8,490,291 B2 7/2013 Churchill et al.
8,621,687 B2 1/2014 Brykalski et al.
8,732,874 B2 5/2014 Brykalski et al.
8,782,830 B2 7/2014 Brykalski et al.
8,782,920 B2 * 7/2014 Marthinsen ..... A45D 20/12 132/211
8,893,329 B2 11/2014 Petrovski et al.
9,125,497 B2 9/2015 Brykalski et al.
9,408,475 B2 8/2016 Mikkelsen et al.
9,808,066 B2 * 11/2017 Moloney ..... A45D 20/10
9,949,570 B1 * 4/2018 Young ..... A47C 21/048
10,085,537 B2 * 10/2018 Maclaine ..... A46B 9/023
2003/0052115 A1 * 3/2003 Leung ..... A45D 20/50 219/222
2003/0188382 A1 * 10/2003 Klamm ..... A47G 9/086 5/413 R
2004/0168337 A1 9/2004 Curtin
2006/0101577 A1 5/2006 Lussier
2006/0198617 A1 * 9/2006 Sirkis ..... A47C 21/048 392/365
2008/0216343 A1 9/2008 Churchill et al.
2009/0093183 A1 4/2009 Randle et al.
2009/0100698 A1 4/2009 Primm
2009/0145002 A1 * 6/2009 Brewer ..... A45D 20/12 34/443
2010/0071130 A1 3/2010 Frias
2010/0290765 A1 11/2010 Lee
2011/0247134 A1 10/2011 Howell et al.
2014/0034039 A1 * 2/2014 Qi ..... F24F 1/01 126/299 D
2015/0121620 A1 * 5/2015 Aramli ..... A47C 21/048 5/423
2015/0296954 A1 * 10/2015 Gray ..... A45D 20/12 34/283
2017/0260685 A1 * 9/2017 Fung ..... D06F 75/18
2017/0299235 A1 10/2017 Hsu

* cited by examiner

INSTANT HAND-HELD BED SHEET WARMER

CROSS-REFERENCE TO RELATED APPLICATIONS

This application claims the benefit of U.S. Provisional Application No. 62/553,224, filed Sep. 1, 2017, which is hereby incorporated by reference in its entirety.

FIELD OF THE INVENTION

The present invention relates to a portable hand-held electrical device for use in the warming of bed sheets and other types of bedding.

BACKGROUND OF THE INVENTION

In cold or moderately-cold climates throughout the world, there is a need for products that can quickly, safely and conveniently warm a person's bed at night. Existing products include electric blankets and heated mattress pads, which can present dangers in their use and require continuous maintenance. Many people are reluctant to use these products because of their safety and health concerns. The breakage of internal heating wires for example can make the use of these products dangerous for consumers, as it could lead to short circuits resulting in a fire or burn hazard. Additionally, these products which rest in close proximity to their users throughout the night may present additional health risks from the electromagnetic field generated by currents passing through the wires of the products.

Other bed warming products include stationary hot air devices which remain on throughout the night, generating noise which may disturb one's sleep as well as lacking portability for use on multiple beds. Still others, such as hand-held warming devices proposed in the past, often require assembly or removable attachments, which delay one's use, as well as lacking the efficient design configuration noted in this application.

SUMMARY OF THE INVENTION

The present invention addresses the aforementioned shortcomings in the art by providing a portable hand-held electrical device for use in the warming of bed sheets. Also referred to as the "MAGIC WAND INSTANT BED SHEET WARMER", the device of the present invention will be of great use to the millions of people living in cold or moderately-cold climates throughout the world. It safely warms bed sheets quickly and saves on the cost of heating an entire bedroom. It may be used on multiple beds because of its portable design. The present invention may be used with various types of bedding, including but not limited to bed sheets, blankets, comforters, mattress covers and other bedding elements that a user may sleep on or under that may benefit from being heated.

The apparatus according to the present invention is a hand-held electrical device used to heat bed sheets quickly prior to lying down to sleep. Utilizing a ceramic heating coil and centrifugal fan within the insulated handle assembly, hot air is forced through a perforated rod which, in a continuous motion, is swept between bed sheets. In less than one minute, the bedding is warmed to a comfortable level, thus eliminating the discomfort and shock of lying down on cold sheets and the increased expense of heating an entire room.

The device of the present invention provides several distinguishing features and advantages over the state of the art, including but not limited to the following:

I) The device comprises a handle assembly including:

A) An elongated handle having indented grips for ease of grasping as well as providing leverage for sweeping the heat distribution rod between sheets;

B) A spring release switch that automatically turns off the device the moment one releases the handle (providing a safety feature); and C) A fresh air intake at the extended end of the handle eliminating short circuiting of heated air from beneath the sheets as well as keeping the handle cool.

II) The device also comprises a warm air heater and fan assembly including:

A) A ceramic heating element for providing instant heat so the device may be used immediately and also generating infrared heat that penetrates bedding; and B) A centrifugal fan that provides direct, constant high pressure air flow and lower noise than an axial fan.

III) The device further comprises a warm air distribution rod, including:

A) A single piece rod that is self-contained for immediate use, requiring no attachments or assembly of removable parts;

B) A long rigid design (e.g., 30 inches) for extended reach beneath bedding and for ease of sweeping (unlike flexible conduit that may bend);

C) Streamlined design (with small diameter) reducing friction when swept between sheets;

D) A swivel connection at the fan/heater housing allowing the rod to freely rotate when swept between sheets;

E) Raised gliders along length of rod allowing for free, unrestricted warm air flow; and F) Deflectors along warm air outlet holes creating a spiral flow for quick, deep heating of bedding while spreading sheets apart for ease of sweeping the rod between sheets.

The product of the present invention provides a number of benefits to the user which can be summarized, without limitation, as follows:

1) Personal Comfort: The apparatus of the present invention warms bed sheets quickly, eliminating both the shock and discomfort of lying down on cold sheets. Utilizing forced convection with spiral air flow, the apparatus of the present invention deep warms bedding and dries out dampness, making it easier for the user to fall asleep.

2) Health Benefits: The apparatus of the present invention also allows the user to avoid overheating the entire bedroom, which may dry out the mucous membrane lining, leaving one more susceptible to colds and flu infections.

3) Sanitizing effects: The apparatus of the present invention helps rid the bed of dust mites which can trigger asthma and allergies.

4) Ease of use: Allows for immediate use requiring no attachments or assembly of removable parts, as do other hand-held devices.

5) Efficiency: Within only one minute, the apparatus of the present invention warms bed sheets to a comfortable level, using little electricity. Electric blankets, because of lower wattage (100 watts), take much longer to provide an equivalent amount of warmth (e.g., 20 to 25 minutes).

6) Quiet Operation: Because the apparatus does not remain on throughout the night as do other devices, it does not generate sleep disturbing noise.
7) Peace of Mind: The apparatus of the present invention avoids the fire hazard and health risk concerns posed by the use of electric blankets and heated mattress pads.
8) Cost Savings: Use of the apparatus of the present invention may lower home fuel costs by reducing the temperature needed to heat an entire bedroom.
9) Eco-Friendly: As a result of the reduced energy usage of the apparatus of the invention, it lowers consumption of fossil fuels and $CO_2$ emissions.

The present invention incorporates several important safety features, including but not limited to:

1) Dual Wattage for branch circuit overload protection, including a reset option, (per NEC, Article 210-23(a));
2) A temperature cutoff switch within the fan/heating coil assembly, with a thermal fuse for added safety;
3) A Ground Fault Interrupter (GFI) at the end of the electrical cord, to prevent electric shock;
4) A protective screen and lint filter over the air intake, which can be removable for ease of cleaning;
5) A heat shield including insulated lining of the fan/heating coil assembly, within ABS plastic housing; and
6) A spring release on-off switch arranged on the handle to turn off device automatically upon release of the handle by the user.

In accordance with the present invention, an apparatus for heating bedding, such as bed sheets, blankets, comforters, mattress covers and other bedding is provided. The apparatus comprises an air intake configured to intake air; a fan and heating coil assembly to receive and heat the air to provide warmed air; a handle configured in between the air intake and the fan and heating coil assembly and comprising a hollow cavity formed therein to allow the air to pass through the handle from the air intake to the fan and heating coil assembly; and a warm air distributor rod configured to receive the warmed air and comprising a plurality of outlet vents configured to distribute the warm aired to the bedding. The air intake, the fan and heating coil assembly, the handle and the warm air distributor are arranged linearly and the apparatus is configured as a hand-held baton or shaft.

In accordance with an embodiment of the invention, the apparatus further comprises a power switch arranged on the handle configured to control an electric power supply to the apparatus. The power switch can be a spring-released on-off switch that is configured to power off the fan and heating coil when the handle is released by a user.

In accordance with an additional embodiment of the invention, the apparatus further comprises a power cord having a first end attached to the handle and a second end comprising a plug for a wall outlet, wherein the power cord is configured to supply electric power to the apparatus from the wall outlet. The power cord further comprises a ground fault interrupter. The apparatus further provides a dual wattage option for circuit overload protection. The dual wattage option provides an added safety precaution for older homes that may only have 15 amp electrical wall outlets, rather than 20 amp outlets.

In accordance with a further embodiment of the invention, the heating coil of the fan and heating coil assembly may comprise a ceramic heating coil for quick heat-up. The fan of the fan and heating coil assembly may be of a centrifugal fan design to provide a constant high pressure air flow and low noise. The fan and heating coil assembly may also comprise an insulating layer formed around at least the heating coil. The fan and heating coil assembly may also comprise a thermal cutoff switch configured to cut off power to the fan and heating coil assembly if the fan and heating coil assembly reaches a predefined maximum temperature.

In accordance with an embodiment of the apparatus of the invention, the air intake comprises a protective screen and filter configured to filter the air entering the air intake.

In accordance with a further embodiment of the apparatus of the invention, the plurality of outlet vents of the warm air distributor rod are arranged along the entire length of the warm air distributor rod. The warm air distributor rod may further comprise a plurality of gliders configured to provide a space between a surface of the bedding and the plurality of outlet vents of the warm air distributor rod. Each of the plurality of outlet vents may also comprise one or more warm air deflectors to provide a spiral air flow for deep heating of bedding. In certain embodiments of the invention, the warm air distributor rod is configured to be attachable and detachable from the apparatus for storage purposes. The warm air distributor rod may also be configured to have an adjustable length. In additional or alternative embodiments of the apparatus, a swivel connection connected to the warm air distributor rod configured to enable the warm air distributor rod to rotate freely during use of the apparatus.

DETAILED DESCRIPTION OF THE INVENTION

Figure 1:
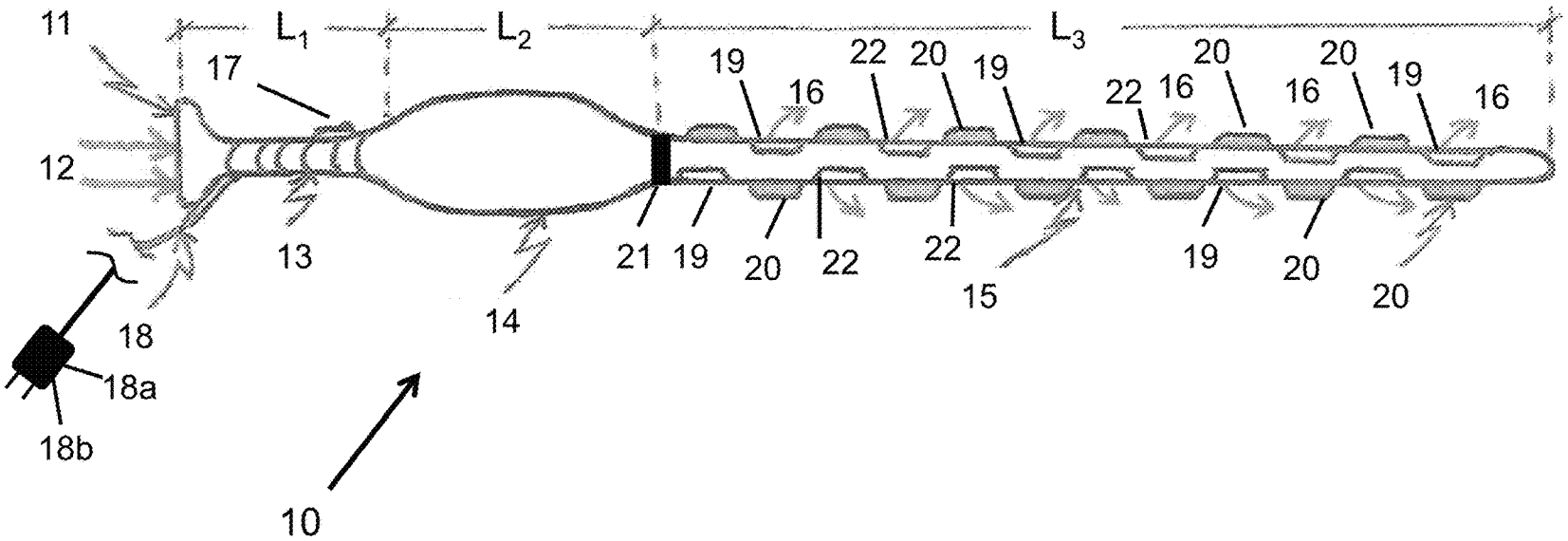
FIG. 1 shows an embodiment of the bed sheet warmer device according to the present invention.

An exemplary embodiment of an apparatus 10 of the present invention is shown in FIG. 1.

The apparatus 10 of the present invention is a hand-held bed sheet warmer that includes an air intake 11 at one end of the apparatus 10 to intake fresh air 12, a handle 13, a fan and heating coil assembly 14 to heat the cooler fresh air 12, and a warm air distributor rod 15 configured to distribute the warmed air 16 to heat the bed sheets. In a preferred embodiment, the apparatus 10 is preferably configured in an elongated rod, baton or shaft with the aforementioned components arranged linearly, as shown for example in FIG. 1.

Figure 2:
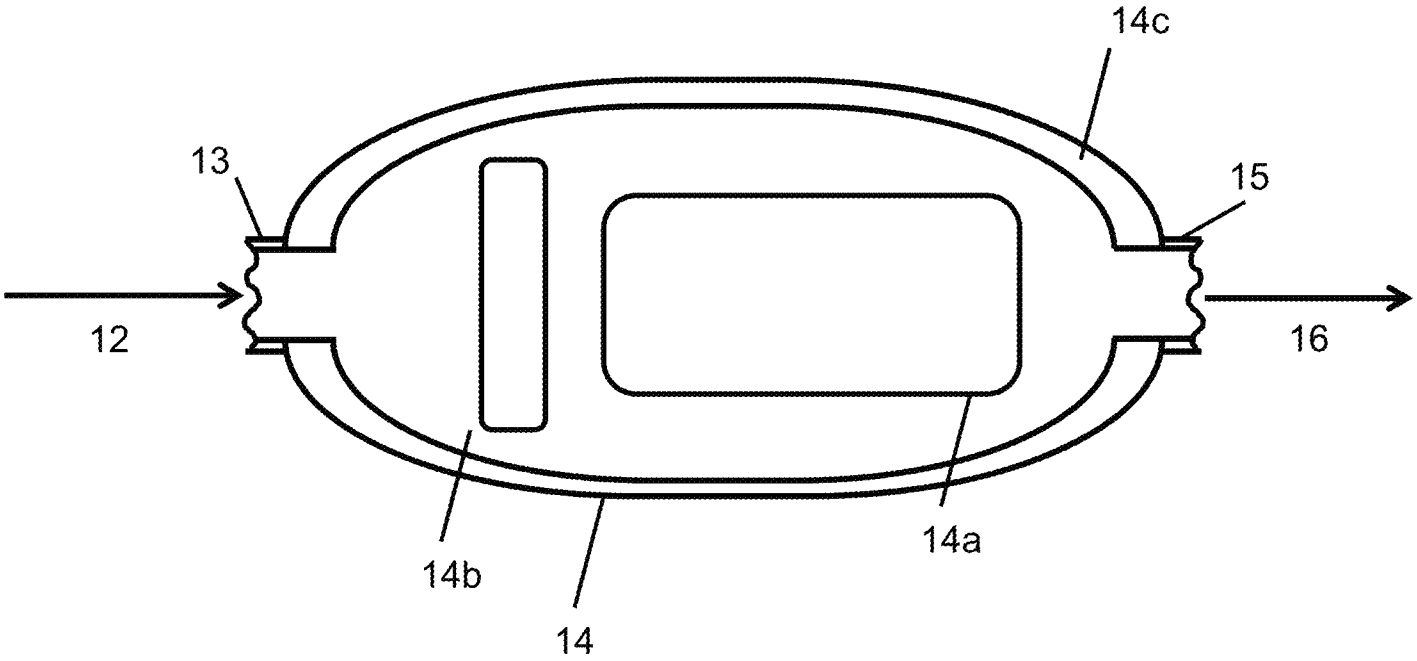
FIG. 2 shows a cross-sectional view of a fan and heating coil assembly of the bed sheet warmer device according to an embodiment of the present invention.

The apparatus 10 includes a handle 13 with which the operator can control the a2 apparatus 10. The handle 13 in an exemplary embodiment can have a length ($L_1$) of approximately five inches. The handle 13 is preferably arranged at an end of the apparatus 10 opposite the warm air distributor rod 15 and positioned in between the air intake 11 and the fan/heating coil assembly 14, which in a preferred embodiment shown for example in FIG. 2, includes a ceramic heating element 14*a* and centrifugal fan 14*b*. The fan/heating coil assembly 14 and the warm air distributor rod 15 are the warmest parts of the apparatus 10. By positioning the handle 13 next to the fan/heating coil assembly 14, the handle 13 is not arranged on top of or overlapping the fan/heating coil assembly 14, and the user's hand is less exposed to any heat emanating from the fan/heating coil assembly 14. The handle 13 is positioned at an end of the apparatus 10 such that the user can comfortably hold the apparatus 10 while keeping the warm air distributor rod 15 pointed away from the user. The handle 13 comprises a hollow cavity or passage formed therein to supply fresh air 12 from the air intake 11 through the handle 13 to the fan/heating coil assembly 14. The fresh air 12 passing through the hollow handle 13 helps to keep the handle 13 cool. The handle 13 may also comprise external surface elements, such as indented grips, configured to aid the user in gripping the handle 13.

The handle 13 further comprises a power switch 17 to turn the apparatus 10 on and off. When the apparatus 10 is powered on by the power switch 17, the fan and heating coil assembly 14 is powered on and fresh air 12 enters the apparatus 10 through the air intake 11 and is provided for heating by the fan and heating coil assembly 14. The power switch 17 is a spring released on-off switch. This provides additional safety benefits because when the user releases the switch 17, the apparatus 10 is automatically powered off. As a result, the user cannot inadvertently leave the heating apparatus 10 on when out of the room or when the apparatus 10 is not in use.

In a preferred embodiment, the power switch 17 is also arranged on the handle 13 so that when the user releases the handle 13 to let go of the apparatus 10, the apparatus 10 and the fan and heating coil assembly 14 are shut off. In this manner, the apparatus 10 can be easily operated with one hand and the user does not have to power off the apparatus 10 using a separate hand that is not holding the apparatus 10 or put down the apparatus 10 in order to power the apparatus 10 off. Further, if the apparatus 10 is dropped by the user, the apparatus 10 will shut off.

The apparatus 10 can be powered by plugging the apparatus 10 into a standard electric wall outlet using an electric power cord 18 of the apparatus. In an exemplary embodiment, the power cord 18 is a 360 degree swivel cord attached to the handle 13 at the base end of the apparatus 10 having a plug 18*a*. The electric power cord 18 is also configured with a ground fault interrupter (GFI) 18*b* to increase the safety of the apparatus 10 by protecting the user from electric shock. The apparatus 10 provides a dual wattage option, for branch circuit overload protection (12 amps/1440 watts for a 15 amp electrical outlet, and 15.6 amps/1875 watts for a 20 amp electrical outlet, in order to comply with the National Electrical Code (NEC) 80% Rule, Sec. 210-23 (a)).

The apparatus 10 further comprises a fan and heating coil assembly 14. The fan/heating coil assembly 14 receives cooler fresh air 12 from the air intake 11. The cooler fresh air 12 passes through the handle 13 to the fan/heating coil assembly 14. The fan/heating coil assembly 14 heats the air 12, and forces the heated air 16 through a hot air distributor rod 15, which comprises one or more outlet vents 19 through which the heated air 16 exits the hot air distributor rod 15. In an exemplary embodiment, the fan/heating coil assembly 14 may have a length ($L_2$) of approximately five inches. In an embodiment of the apparatus 10, the heating coil 14*a* of the fan and heating coil assembly 14 can be a ceramic heating coil, which aids in accelerating the heating process and allows the coil to retain heat longer. Additionally, the fan 14*b* of the fan and heating coil assembly 14 may be a centrifugal fan. An insulating layer 14*c*, including for example a double layer of ABS plastic, can surround the heating coil and fan assembly 14 to protect the user from excess heat emitted by the apparatus 10.

The fan and heating coil assembly 14 are further configured with a thermal cutoff switch (not shown). With the thermal cutoff switch, when the apparatus 10 reaches a critical, predefined maximum temperature, the apparatus 10 will automatically power off. The thermal cutoff switch may include a bimetallic strip as well as a thermal fuse for added safety. As a result, the apparatus 10 has an increased level of safety by forcing the apparatus 10 to power off before overheating.

Figure 3:
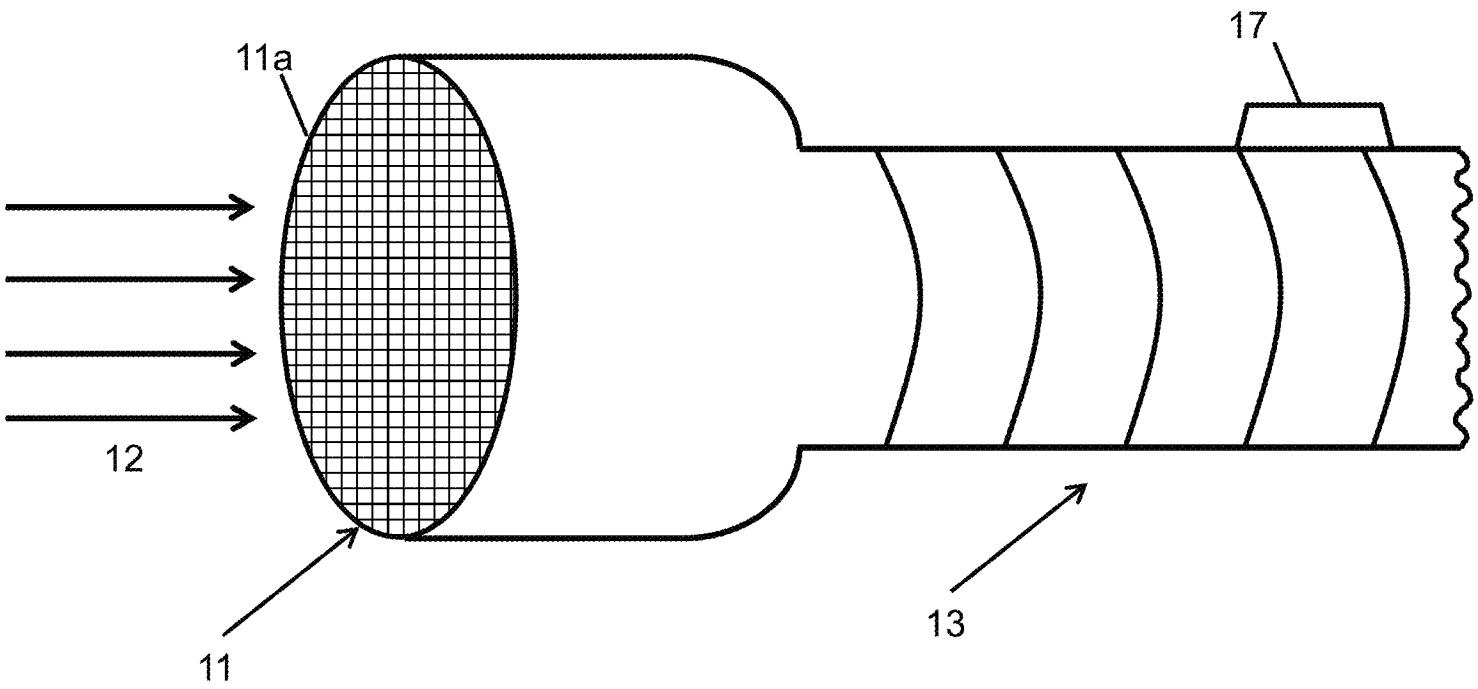
FIG. 3 shows a view of a handle of the bed sheet warmer device according to an embodiment of the present invention.

In the embodiment shown in FIGS. 1 and 3, a fresh air intake 11 is provided at the end of the handle 13. This remote fresh air intake 11 at the end of the handle 13 prevents short circuitry of the warm air flow in the apparatus 10 and the resultant overheating of the thermal cutoff switch. A removable stainless steel protective grill and lint filter 11*a* is provided to cover the air intake 11 and prevent particulates and debris from entering the apparatus 10, and may be removable for ease of cleaning. In alternative embodiments, the protective grill and filter 11*a* can be made from other materials, including but not limited to plastic materials or mesh materials.

The incoming fresh air 12 is heated by the fan and heating coil assembly 14 and distributed through an elongated warm air distributor rod 15, which includes one or more outlet vents 19. In a preferred embodiment of the invention, a plurality of outlet vents 19 are provided along the entire length of the warm air distributor rod 15. In the embodiment shown in FIG. 1, the warm air distributor rod 15 has a length ($L_3$) of thirty inches and may have a tapered design with raised gliders 20 for ease of inserting and sliding the warm air distributor rod 15 between sheets and for an extended reach into sheets. The gliders 20 contact the sheets and allow a space to be provided between the outlet vents 19 of the warm air distributor rod 15 and the sheets when the warm air distributor rod 15 is being passed between or over the sheets. High speed forced convection (e.g., 50-60 cubic feet per minute) is utilized for uniform distribution of heat throughout the sheets powered by the centrifugal fan. Further, a spiral air flow utilizing offset warm air outlet vents 19 in the warm air distributor rod 15 with directional deflectors 22 provides deep warming of bedding, including sheets, blankets and mattress covers. In one embodiment of the apparatus 10, twelve outlet vents may be provided along the length of the warm air distributor rod 15, but this number may vary.

In certain embodiments of the apparatus 10, the warm air distributor rod 15 may have an alternate length other than thirty inches or may be a telescoping to have an adjustable length. Further, the warm air distributor rod 15 may be detachable from the apparatus 10 for cleaning or for storage, such as by being threaded or locked into corresponding threading or locking elements at an end of the fan/heating coil assembly 14. In such an embodiment, multiple, separate warm air distributor rods 15 can be provided for use with the apparatus 10 having varying lengths, which can be used with the apparatus 10 interchangeably depending on the length of warm air distributor rod 15 needed for a particular application. The apparatus 10 may further comprise a swivel connection 21 connected to the warm air distributor rod 15 that is configured to enable the warm air distributor rod 15 to rotate freely during operation of the apparatus 10, such that the plurality of outlet vents 19 are rotating in a circular motion during operation of the apparatus 10, further enabling the distribution rod 15 to glide smoothly between the bed sheets. The outlet vents 19 of the warm air distributor rod 15 may also include deflectors to direct the flow out of the outlet vents 19 to create a spiral flow for quick, deep heating of bedding.

The apparatus 10 can be operated by sweeping the apparatus 10 in a continuous motion between bed sheets. In less than one minute, bedding is warmed by the warm air 16 to a comfortable level, thus eliminating both the discomfort and shock of lying down on cold sheets, and the ever-increasing expense of heating an entire room. After the apparatus 10 is used, it can be powered off and stored or, because of its portable design, used again on a different bed.

The present invention may comprise alternative dimensions from those shown in FIG. 1 and described above, as would be appreciated by a person of ordinary skill in the art.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. An apparatus for heating bedding, comprising:

a fan and heating coil assembly to receive and heat air to provide warmed air, the fan and heating coil assembly comprising a fan and a heating coil;

a single air intake configured to intake the air that is received by the fan and heating coil and provided as warmed air;

a handle configured in between the air intake and the fan and heating coil assembly and comprising a hollow cavity formed therein to allow the air to pass through the handle from the air intake to the fan and heating coil assembly;

a warm air distributor rod configured to receive the warmed air and comprising a plurality of outlet vents configured to distribute the warmed air to the bedding;

wherein the air intake, the fan and heating coil assembly, the handle and the warm air distributor rod are arranged linearly and the apparatus is configured as a hand-held baton or shaft;

wherein the handle comprises a proximal end and a distal end, wherein the proximal end adjacent to the fan and heating coil assembly;

wherein the air intake is arranged on the distal end of the handle, wherein the handle comprises an elongated section formed between the proximal and distal ends and configured to be gripped by a user of the apparatus, and a swivel connection connected between the warm air distributor rod and the fan and heating coil assembly, wherein the swivel configured to enable the warm air distributor rod to rotate freely during use of the apparatus.

2. The apparatus according to claim 1, further comprising a power switch arranged on the handle configured to control an electric power supply to the apparatus.

3. The apparatus according to claim 2, wherein the power switch is a spring-released on-off switch that is configured to power off the fan and heating coil when the handle is released by a user.

4. The apparatus according to claim 1, wherein the heating coil of the fan and heating coil assembly comprises a ceramic heating coil.

5. The apparatus according to claim 1, wherein the fan of the fan and heating coil assembly is a centrifugal fan.

6. The apparatus according to claim 1, further comprising an insulating layer formed around the heating coil and fan assembly.

7. The apparatus according to claim 1, wherein the fan and heating coil assembly comprises a thermal cutoff switch configured to cut off power to the fan and heating coil assembly if the fan and heating coil assembly reaches a predefined maximum temperature.

8. The apparatus according to claim 1, wherein the air intake comprises a protective screen and filter configured to filter the air entering the air intake.

9. The apparatus according to claim 1, wherein the plurality of outlet vents of the warm air distributor rod are arranged along the entire length of the warm air distributor rod.

10. The apparatus according to claim 1, wherein the warm air distributor rod further comprises a plurality of gliders configured to provide a space between a surface of the bedding and the plurality of outlet vents of the warm air distributor rod.

11. The apparatus according to claim 1, wherein the warm air distributor rod is configured to be attachable and detachable from the apparatus so that the warm air distributor rod can be stored separately from the apparatus.

12. The apparatus according to claim 1, wherein the warm air distributor rod is configured to have an adjustable length.

13. The apparatus according to claim 1, wherein each of the plurality of outlet vents comprises one or more deflectors to provide a spiral air flow for deep heating of bedding.

14. The apparatus according to claim 1, further comprising:

a spring release power switch arranged on the handle configured to control an electric power supply to the apparatus; and a power cord having a first end attached to the handle and a second end comprising a plug for a wall outlet, wherein the power cord is configured to supply electric power to the apparatus from the wall outlet;

wherein the warm air distributor rod comprises the plurality of outlet vents along the length of the warm air distributor rod and a plurality of gliders configured to provide a space between a surface of the bedding and the plurality of outlet vents.

15. The apparatus according to claim 14, further comprising:

a ground fault interrupter;

an insulating layer formed around the fan and heating coil assembly;

a thermal cutoff switch configured to cut off power to the fan and heating coil assembly if the fan and heating coil assembly reaches a predefined maximum temperature; and a protective screen and filter configured to filter the air entering the air intake.

16. The apparatus according to claim 1, wherein the warm air distributor rod further has a length of thirty inches.

17. The apparatus according to claim 12, wherein the length of the warm air distributor rod is adjustable up to a length of thirty inches.

* * * * *